US011703059B2

(12) United States Patent
Huang et al.

(10) Patent No.: US 11,703,059 B2
(45) Date of Patent: Jul. 18, 2023

(54) DIGITAL INFLATION AND DEFLATION ADJUSTMENT STRUCTURE FOR A PUMP

(71) Applicant: Intex Marketing Ltd., Tortola (VG)

(72) Inventors: Zhi Xiong Huang, Fujian (CN); Huai Tian Wang, Fujian (CN); Yaw Yuan Hsu, Fujian (CN)

(73) Assignee: Intex Marketing Ltd., Tortola (VG)

( * ) Notice: Subject to any disclaimer, the term of this patent is extended or adjusted under 35 U.S.C. 154(b) by 25 days.

(21) Appl. No.: 17/055,729

(22) PCT Filed: May 16, 2019

(86) PCT No.: PCT/IB2019/054081

§ 371 (c)(1),
(2) Date: Nov. 16, 2020

(87) PCT Pub. No.: WO2019/220399

PCT Pub. Date: Nov. 21, 2019

(65) Prior Publication Data

US 2021/0207605 A1 Jul. 8, 2021

(30) Foreign Application Priority Data

May 16, 2018 (CN) ..... 201820730835.6
Jan. 17, 2019 (CN) ..... 201920076287.4

(51) Int. Cl.
*F04D 25/06* (2006.01)
*F04D 25/16* (2006.01)
(Continued)

(52) U.S. Cl.
CPC ..... *F04D 25/06* (2013.01); *F04D 17/16* (2013.01); *F04D 25/0606* (2013.01);
(Continued)

(58) Field of Classification Search
None
See application file for complete search history.

(56) References Cited

U.S. PATENT DOCUMENTS 6,623,249 B1 * 9/2003 Rogers ..... F04B 41/06 417/428
6,698,046 B1 3/2004 Wu
(Continued)

FOREIGN PATENT DOCUMENTS

CN 203516155 U 4/2014
CN 107795517 A 3/2018
CN 207131607 U 3/2018

OTHER PUBLICATIONS

International Searching Authority, International Preliminary Report on Patentability and Written Opinion, International Application No. PCT/IB2019/054081, dated Oct. 8, 2019, 4 pages.

*Primary Examiner* — Nathan C Zollinger
*Assistant Examiner* — Timothy P Solak
(74) *Attorney, Agent, or Firm* — Faegre Drinker Biddle & Reath LLP

(57) ABSTRACT

The present disclosure relates to electronically-controlled air assemblies having an inflation, a deflation, and a closed state for use with inflatable products, such as air mattresses. Specifically, the present disclosure relates to air assemblies where the configuration of the air assembly can be changed by a user operating a directional control valve to inflate, deflate, or close an inflatable product. The air assembly may also maintain a predetermined air pressure value within the inflatable product.

16 Claims, 12 Drawing Sheets

(51) Int. Cl.

| | |
|---|---|
| ***F04D 27/00*** | (2006.01) |
| ***F04D 25/10*** | (2006.01) |
| ***F04D 17/16*** | (2006.01) |
| *F04D 29/08* | (2006.01) |

(52) U.S. Cl.
CPC ..... *F04D 25/10* (2013.01); *F04D 25/16* (2013.01); *F04D 27/008* (2013.01); *F04D 29/083* (2013.01)

(56) References Cited

U.S. PATENT DOCUMENTS

| | | | | |
|---|---|---|---|---|
| 6,733,254 | B1 | 5/2004 | Yen | |
| 6,832,629 | B2 | 12/2004 | Wu | |
| 7,128,525 | B2 | 10/2006 | Tsai | |
| 7,198,076 | B2 * | 4/2007 | Wu | F04D 25/084 141/10 |
| 7,225,488 | B2 | 6/2007 | Wu | |
| 7,284,968 | B2 * | 10/2007 | Tsai | F04D 25/084 417/423.1 |
| 7,588,425 | B2 | 9/2009 | Chung | |
| 8,210,834 | B2 * | 7/2012 | Tsai | A47C 27/082 5/713 |
| 8,863,771 | B2 * | 10/2014 | Wang | F04D 25/084 137/565.17 |
| 9,211,018 | B2 * | 12/2015 | Wang | F04D 29/503 |
| 9,279,430 | B2 * | 3/2016 | Chaffee | A47C 27/082 |
| 9,879,682 | B1 * | 1/2018 | Beliveau | A47C 27/082 |
| 2004/0261183 | A1 | 12/2004 | Tsai | |
| 2006/0073012 | A1 | 4/2006 | Song et al. | |

* cited by examiner

DIGITAL INFLATION AND DEFLATION ADJUSTMENT STRUCTURE FOR A PUMP

CROSS-REFERENCE TO RELATED APPLICATIONS

This application is a national stage application of PCT International Application No. PCT/IB2019/054081, filed May 16, 2019, which claims priority to Chinese Application Serial No. 201820730835.6, filed May 16, 2018, and Chinese Application Serial No. 201920076287.4, filed Jan. 17, 2019, the disclosures of which are hereby expressly incorporated by reference herein in their entirety.

FIELD OF THE DISCLOSURE

The present disclosure relates to electronically-controlled air assemblies having an inflation, a deflation, and a closed state for use with inflatable products, such as air mattresses.

BACKGROUND OF THE DISCLOSURE

Inflatable products are common in households due to the convenience of storage or transportation when such products are in a deflated state coupled with the utility of such products when in an inflated state. For example, air mattresses are often used in households both inside and outside of the home for activities such as camping or providing overnight guests with a bed. Air mattresses are generally provided with at least one inflatable air chamber and may be inflated or deflated using an associated pump.

Many existing inflation and deflation pumps are constructed using a check valve and a directional control valve that coordinate with each other. Generally, pumps with less complexity and associated lower costs and smaller size are desired.

SUMMARY

The present disclosure relates to air assemblies having an inflation, a deflation, and a closed state for use with inflatable products, such as air mattresses. Specifically, the present disclosure relates to air assemblies where the configuration of the air assembly can be changed by a user operating a directional control valve to inflate, deflate, or close an inflatable product. The air assembly may also be detachable from the inflatable product. The air assembly may also maintain a predetermined air pressure value within the inflatable product.

According an exemplary embodiment of the present disclosure, an air assembly is provided for use with an inflatable product, the air assembly including a main body forming a main body chamber, the main body comprising at least one vent in communication with the inflatable product; a control panel coupled to the main body, the control panel comprising a vent in communication with the surrounding environment and the main body chamber; an electronic actuator disposed on the control panel and operably coupled to a first circuit board; a pump body disposed in the main body chamber; a pump cover disposed in the main body chamber, the pump cover cooperating with the pump body to form an impeller chamber and including an air inlet and an air outlet in communication with the impeller chamber; an impeller disposed within the impeller chamber; a first motor disposed within the main body chamber and operably coupled to the impeller, the impeller configured to direct air from the air inlet to the air outlet of the pump cover; a second motor disposed within the main body chamber; and a directional control valve coupled to the second motor and disposed within the main body chamber. The directional control valve is moveable between a first position corresponding to an inflation state in which the directional control valve opens an airway between the air outlet of the pump cover and the at least one vent in the main body to inflate the inflatable product; a second position corresponding to a deflation state in which the directional control valve opens an airway between the air inlet of the pump cover and the at least one vent in the main body to deflate the inflatable product; and a third position corresponding to a closed state in which the directional control valve blocks airflow between the pump cover and the at least one vent in the main body to close the inflatable product.

According another exemplary embodiment of the present disclosure, an air assembly is provided or use with an inflatable product, the air assembly including a main body forming a main body chamber, the main body comprising at least one vent in communication with the inflatable product; a control panel coupled to the main body, the control panel comprising a vent in communication with the surrounding environment and the main body chamber; an electronic actuator disposed on the control panel and communicatively coupled to a first circuit board; a pump body disposed in the main body chamber; a pump cover disposed in the main body chamber, the pump cover cooperating with the pump body to form an impeller chamber and including an air inlet and an air outlet in communication with the impeller chamber; an impeller disposed within the impeller chamber; a first motor disposed within the main body chamber and operably coupled to the impeller, the impeller configured to direct air from the air inlet to the air outlet of the pump cover; and a pressure maintenance assembly. The pressure maintenance assembly includes a pressure detection hole disposed in a panel seat that supports the control panel, the pressure detection hole communicating with the inflatable product; a pressure detection tube with a first end and a second end, the first end coupled to the pressure detection hole; a second circuit board operatively coupled to the first motor, the second circuit board supporting a pressure sensor coupled to the second end of the pressure detection tube; a supplemental pump operably coupled to the first motor opposite the impeller; and an air filling tube with a first end coupled to the supplemental pump and a second end coupled to a second vent located on the main body in communication with the inflatable product.

According yet another exemplary embodiment of the present disclosure, a method of maintaining air pressure in an inflatable product is provided, the method including the steps of providing an air assembly; detecting the air pressure value in the inflatable product using the pressure sensor via the pressure detection tube and the pressure detection hole; comparing the detected air pressure value with a predetermined threshold air pressure value stored by the circuit board; wherein, if the detected air pressure value is equal to or greater than the predetermined threshold air pressure value, the air assembly remains non-operational; and wherein, if the detected air pressure value is less than the predetermined threshold air pressure value, the circuit board renders the motor operational to further inflate the inflatable product by directing air through the air filling tube via the supplemental pump. The air assembly includes a main body forming a main body chamber; a motor disposed within the main body chamber; and a pressure maintenance assembly. The pressure maintenance assembly further includes a pressure detection hole disposed in a panel seat that supports the control panel, the pressure detection hole communicating with the inflatable product; a pressure detection tube with a first end and a second end, the first end coupled to the pressure detection hole; a circuit board operatively coupled to the motor, the circuit board supporting a pressure sensor coupled to the second end of the pressure detection tube; a supplemental pump operably coupled to the motor; and an air filling tube coupled to the supplemental pump.

BRIEF DESCRIPTION OF THE DRAWINGS

The above-mentioned and other features and advantages of this disclosure, and the manner of attaining them, will become more apparent and will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION OF THE DRAWINGS

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

Figure 1:
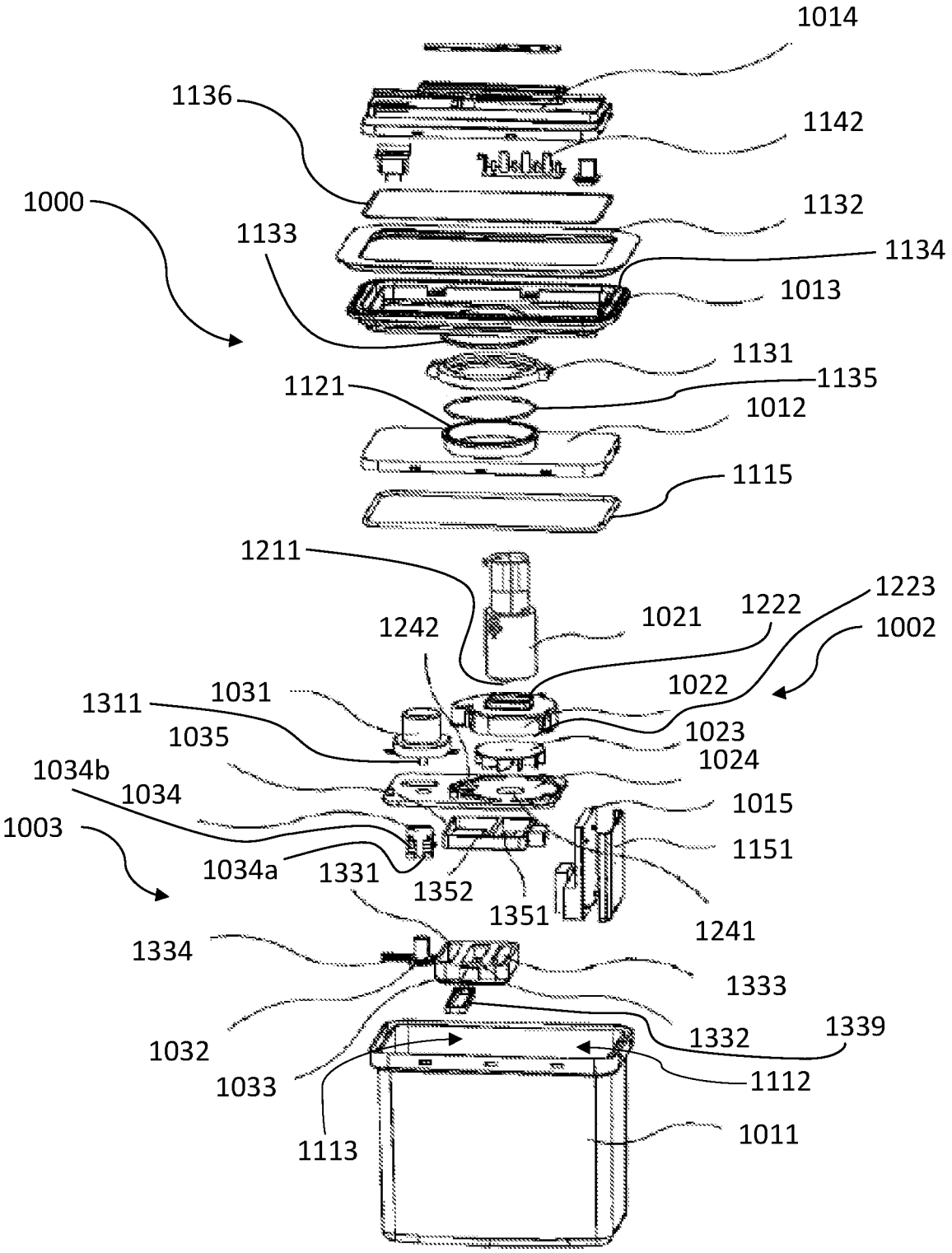
FIG. 1 is an exploded view of an exemplary embodiment of an air assembly of the present disclosure, the air assembly including a main body, a pump assembly, an inflation and deflation switching mechanism, and a control panel.
Figure 1A:
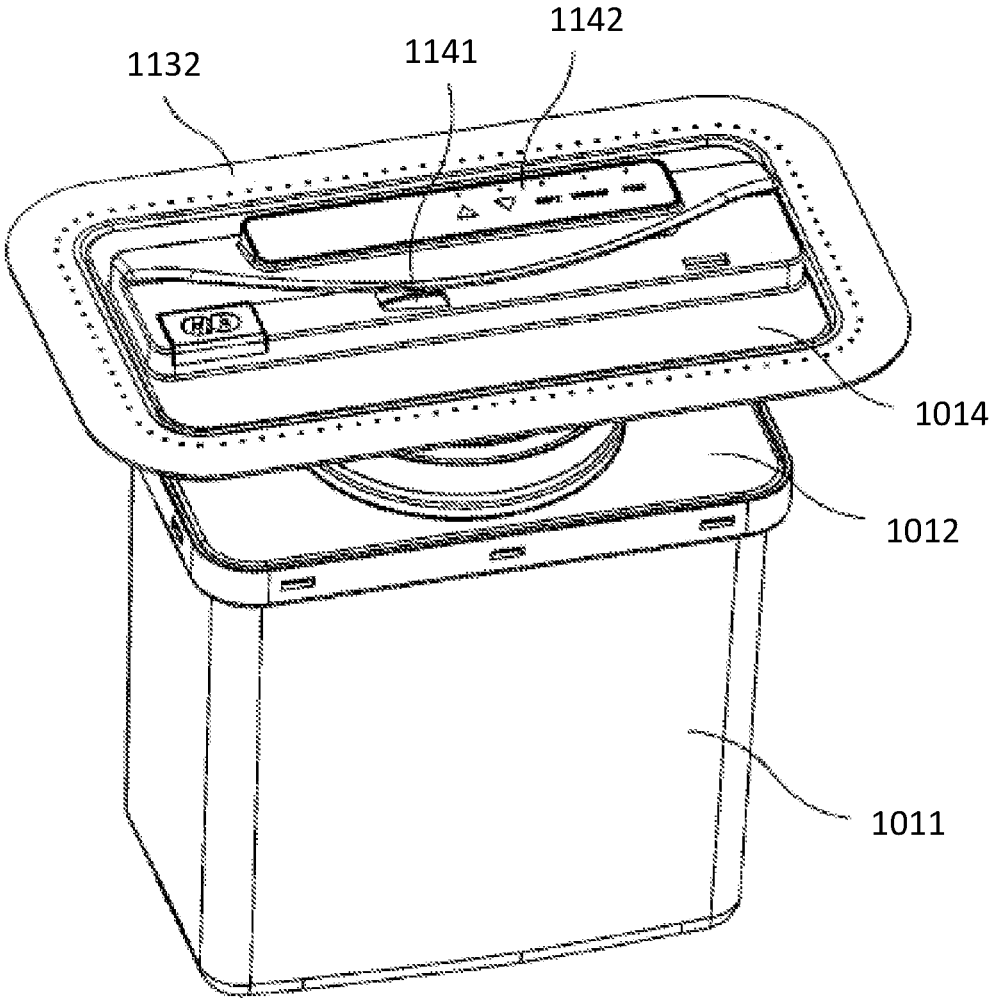
FIG. 1A is a top perspective view of the air assembly of FIG. 1.
Figure 2:
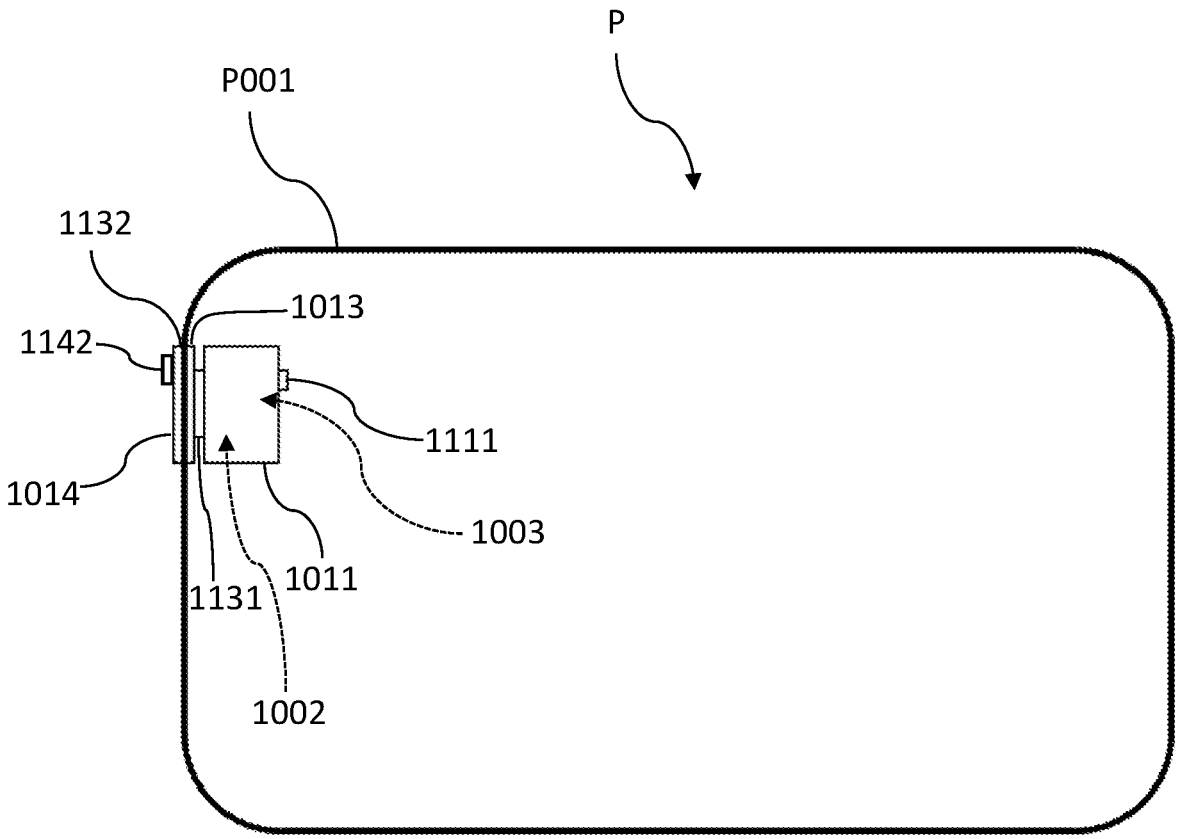
FIG. 2 is a schematic view of the air assembly of FIG. 1 coupled to an inflatable product.

Referring generally to FIGS. 1-7, an air assembly 1000 is disclosed. The air pump assembly 1000 includes a casing or main body 1011, a pump assembly 1002, and an inflation and deflation switching structure 1003. The main body 1011 forms a main body chamber 1112 with an opening 1113. At the end of the main body 1011 opposite the opening 1113 of the main body chamber 1112, the main body 1011 includes an inflation and deflation port 1111 in communication with an inflatable product P (FIG. 2) for inflation and deflation of the inflatable product P (FIG. 2). In other embodiments, a plurality of inflation and deflation ports may be included. In yet other embodiments, a plurality of ports configured to be utilized for only deflation and/or only inflation may be included.

Referring specifically to FIG. 1 and generally to FIGS. 2-7, a main body panel 1012 fits within the opening 1113 of the main body chamber 1112 and is coupled to the main body 1011. In some embodiments, a seal 1115 may be utilized to facilitate a fluid-tight connection between the main body 1011 and the main body panel 1012. An upper portion 1121 of the main body panel 1012 is detachably connected to a lower end 1133 of a panel seat 1013 through a snap ring 1131. In some embodiments, a seal 1135 may be utilized to facilitate a fluid-tight connection between the main body panel 1012 and the snap ring 1131. An upper portion 1134 of the panel seat 1013 is connected to a control panel 1014 and a soft ring 1132. The soft ring 1132 may be comprised of a polymer, e.g. polyvinyl chloride, rubber, etc., and is configured to facilitate coupling the panel seat 1013 with the inflatable product P; in other words, the soft ring 1132 may be welded, adhered, or otherwise attached to a wall of the inflatable product P. A seal 1136 may be disposed between the soft ring 1132 and the control panel 1014 to facilitate a fluid-tight connection between the soft ring 1132 and the control panel 1014. The control panel 1014 includes at least one electronic actuator or control key 1142 that is in electronic communication with a circuit board 1015 covered by a sheath 1151 and disposed in the main body chamber 1112. The circuit board 1015 allows control of the pump assembly 1002 and the inflation and deflation switching structure 1003 via user utilization of the control key 1142. The control panel 1014 further includes a vent 1141 in communication with ambient air to facilitate the introduction of air into the air assembly 1000.

As shown in FIG. 2, when the air assembly 1000 is applied to an inflatable product P, the soft ring 1132 on the panel seat 1013 is coupled to the inflatable product through, by example, welding, adhesion, or other attachment. For example, when the air assembly 1000 and the inflatable product P are coupled, the main body 1011, the pump assembly 1002, and the inflation and deflation switching mechanism 1003 are all disposed within the inflatable product P, and the control panel 1014 is visible on the outer surface P001 of the inflatable product P in such a way that a user can control the air assembly 1000 to be in an inflation state, a deflation state, or a closed state by using the control key 1142 of the control panel 1014. In an illustrative embodiment, the control panel 1014 and the panel seat 1013 are light and small to reduce any coupling difficulty. Once the control panel 1014 and the panel seat 1013 are coupled to the inflatable body P, the main body panel 1012 and the main body 1011 coupled to the main body panel 1012 are connected to the panel seat 1013 through snap ring 1131. The main body 1011 may also be removed from the control panel 1014 through release of the snap ring 1131. The connection between the soft ring 1132 and the inflatable product P must be airtight to ensure functionality of the inflatable product P.

Referring again specifically to FIG. 1, and generally to FIGS. 2-7, the pump assembly 1002 is disposed within the main body chamber 1112 beneath the main body panel 1012.

Specifically, the pump assembly 1002 includes a pump body 1022 supporting a unidirectional motor 1021 which is operatively coupled to the circuit board 1015 to operate the pump assembly 1002 during operation of the air assembly 1000. The motor 1021 is disposed at an upper end 1222 of the pump body 1022 and has a rotating shaft 1211 disposed through the pump body 1022. A pump cover 1024 is connected to a lower end 1223 of the pump body 1022, and the pump cover 1024 coordinates with the pump body 1022 to form a pump body chamber 1221. An impeller 1023 is disposed within the pump body chamber 1221 and is connected to the rotating shaft 1211 of the motor 1021. The pump cover 1024 has an air inlet 1241 and an air outlet 1242 to facilitate airflow into and out of the pump body chamber 1221.

The inflation and deflation switching structure 1003 is disposed within the main body chamber 1112 above the inflation and deflation port 1111 of the main body 1011 and below the pump assembly 1002. The inflation and deflation switching structure 1003 includes a directional control valve 1033 disposed just above the inflation and deflation port 1111. A seal 1339 may be disposed between the inflation and deflation port 1111 and the directional control valve 1033 to facilitate a fluid-tight connection between the inflation and deflation port 1111 and the directional control valve 1033. The directional control valve 1033 has a first vent 1331, a second vent 1332, a third vent 1333, and a rack 1334. The second vent 1332 of the directional control valve 1033 is disposed between the first vent 1331 and the third vent 1333.

Figure 3:
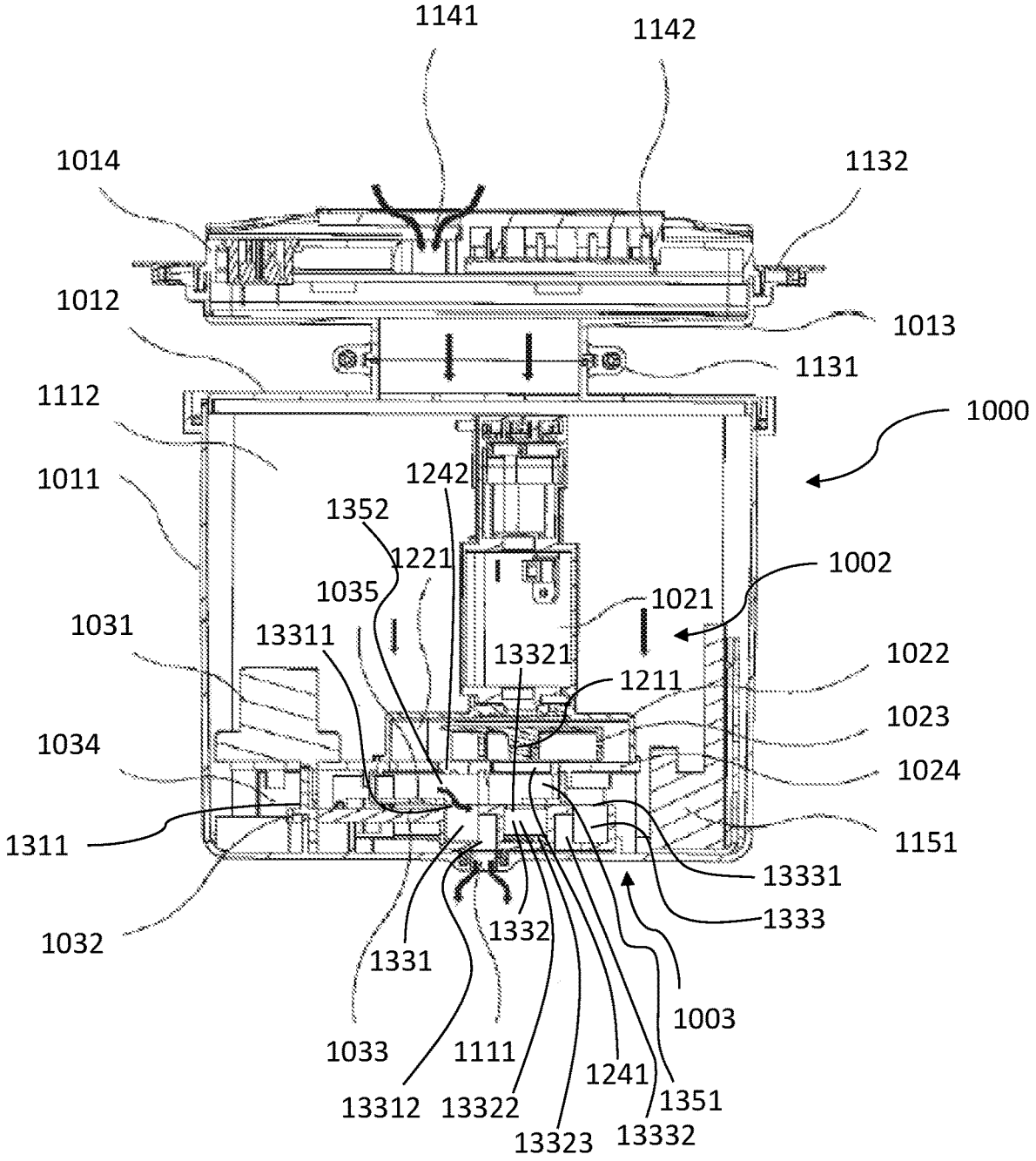
FIG. 3 is a front cross-sectional view of the air assembly of FIG. 1, said air assembly in an inflation state.

Now referring to FIGS. 1 and 3, first opening 13311 of the first vent 1331 is located at an upper end face of the directional control valve 1033, and a second opening 13312 of the first vent 1331 is located at a lower end face of the directional control valve 1033 so that the second opening 13312 may be placed in selective communication with the inflation and deflation port 1111. Similarly, a first opening 13331 of the third vent 1333 is located at the upper end face of the directional control valve 1033, and a second opening 13332 of the third vent 1333 is located at the lower end face of the directional control valve 1033 so that the second opening 13332 may be placed in selective communication with the inflation and deflation port 1111. Like first vent 1331 and third vent 1333, a first opening 13321 of the second vent 1332 is located at the upper end face of the directional control valve 1033; however, a second opening 13322 of the second vent 1332 is located at a side end face of the directional control valve 1033 so that a lower baffle 13323 of the second vent 1332 may selectively seal the inflation and deflation port 1111. The rack 1334 facilitates the engagement of the directional control valve 1033 with a gear disc 1032 disposed within the main body chamber 1112 above the inflation and deflation port 1111 of the main body 1011 near the directional control valve 1033.

A cover plate 1035 is disposed between the pump cover 1024 and the directional control valve 1033. The cover plate 1035 includes a first aperture 1351 in communication with the air inlet 1241 of the pump cover 1024 and in selective communication with either the second vent 1332 or the third vent 1333 of the directional control valve 1033. The cover plate 1035 further includes a second aperture 1352 in communication with the air outlet 1242 of the pump cover 1024 and in selective communication with either the first vent 1331 or the second vent 1332 of the directional control valve 1033. A bidirectional motor 1031 is positioned above the pump cover 1024 and is operatively coupled to the circuit board 1015. The motor 1031 includes a rotating shaft 1311, which is disposed through the pump cover 1024 to couple to the gear disc 1032 so that the motor 1031 may drive the gear disc 1032 to rotate. The gear disc 1032 can then drive the directional control valve 1033 to move via the rack 1334. The cover plate 1035 further coordinates with an optical coupler detection plate 1034, which is in operative communication with the circuit board 1015 and coordinates with a sensed element 1335 (FIG. 4) located on the rack 1334 during operation of the assembly 1000. Specifically, the optical coupler detection plate 1034 has right-side inflation sensors 1034*a* and left-side deflation sensors 1034*b*, wherein each set of sensors 1034*a*, 1034*b* correspond to a state of the air assembly 1000 when contacted or otherwise sensed by sensed element 1335.

Figure 4:
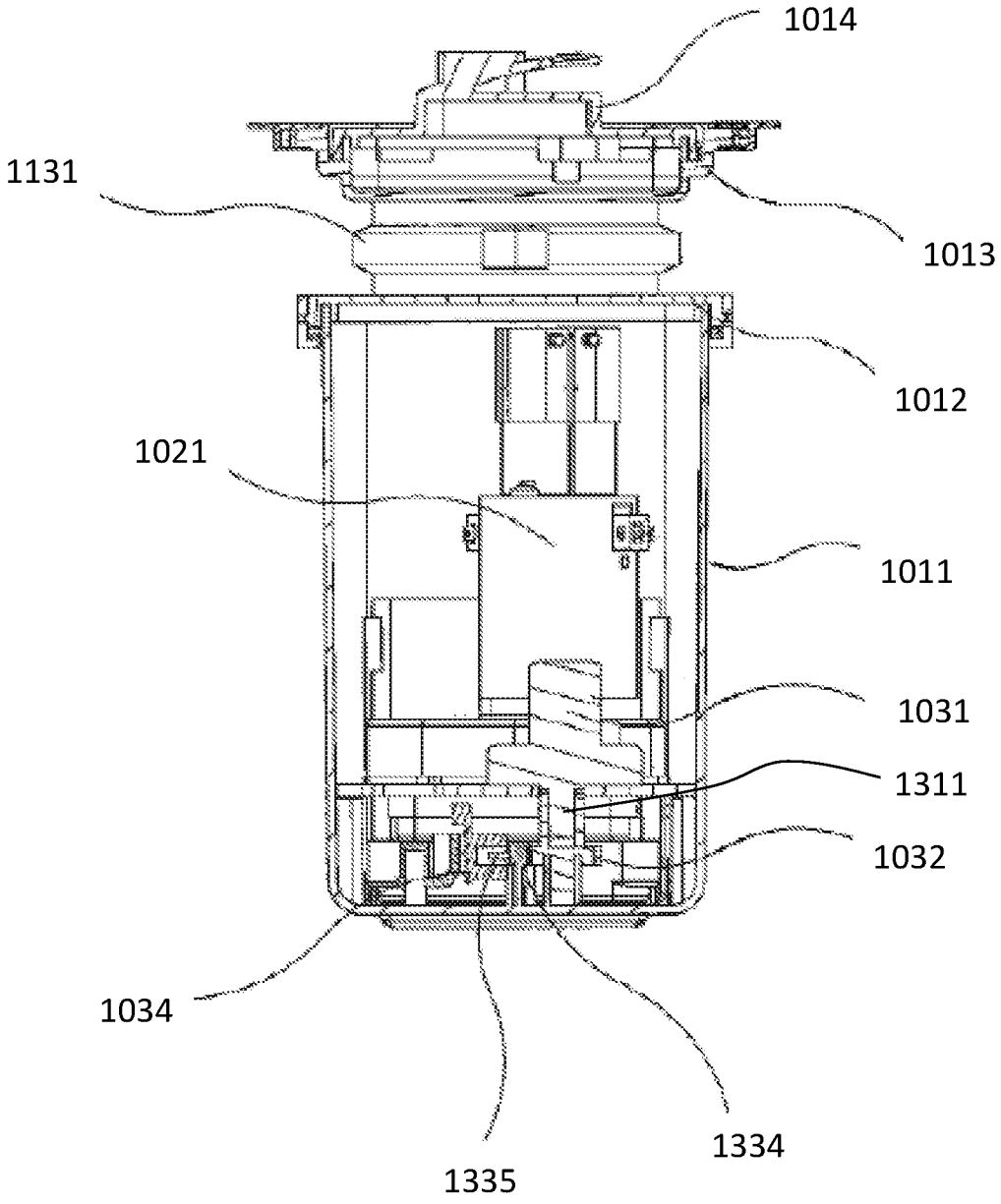
FIG. 4 is a side cross-sectional view of the air assembly of FIG. 3.

For example, when the user uses the control key 1142 to place the air assembly 1000 in the inflation state, as shown in FIGS. 3 and 4, the bidirectional motor 1031 of the inflation and deflation switching mechanism 1003 drives the gear disc 1032 to rotate in a first direction, causing the gear disc 1032 to drive the directional control valve 1033 to move via the rack 1334. The bidirectional motor 1031 continues to drive the gear disc 1032 and the directional control valve 1033 via the rack 1334 until the first vent 1331 of the directional control valve 1033 is placed into communication with the inflation and deflation port 1111 of the main body 1011, the second aperture 1352 of the cover plate 1035, and the air outlet 1242 of the pump cover 1024. At this point, the second vent 1332 of the directional control valve 1033 is in communication with the main body chamber 1112, the first aperture 1351 of the cover plate 1035, and the air inlet 1241 of the pump cover 1024. Furthermore, the sensed element 1335 of the rack 1334 touches the right-side inflation sensors 1034*a* of the optical coupler detection plate 1034 (FIG. 1), at which point the motor 1031 stops operation.

When the sensed element 1335 on the rack 1334 is detected by the optical coupler detection plate 1034, the bidirectional motor 1031 stops operation, and the circuit board 1015 starts the unidirectional motor 1021 of the pump assembly 1002. The unidirectional motor 1021 drives the impeller 1023 to rotate via the rotating shaft 1211 so that ambient air is drawn through the vent 1141 of the control panel 1014. The air in the main body chamber 1112 is then drawn through the second vent 1332 of the directional control valve 1033, the first aperture 1351 of the cover plate 1035, and the air inlet 1241 of the pump cover 1024 into the pump body chamber 1221. The air is then free to pass through the air outlet 1242 of the pump cover 1024, the second aperture 1352 of the cover plate 1035, the first vent 1331 of the directional control valve 1033, and enters the inflatable product P through the inflation and deflation port 1111 of the main body 1011, thus inflating the inflatable product P (FIG. 2).

Figure 7:
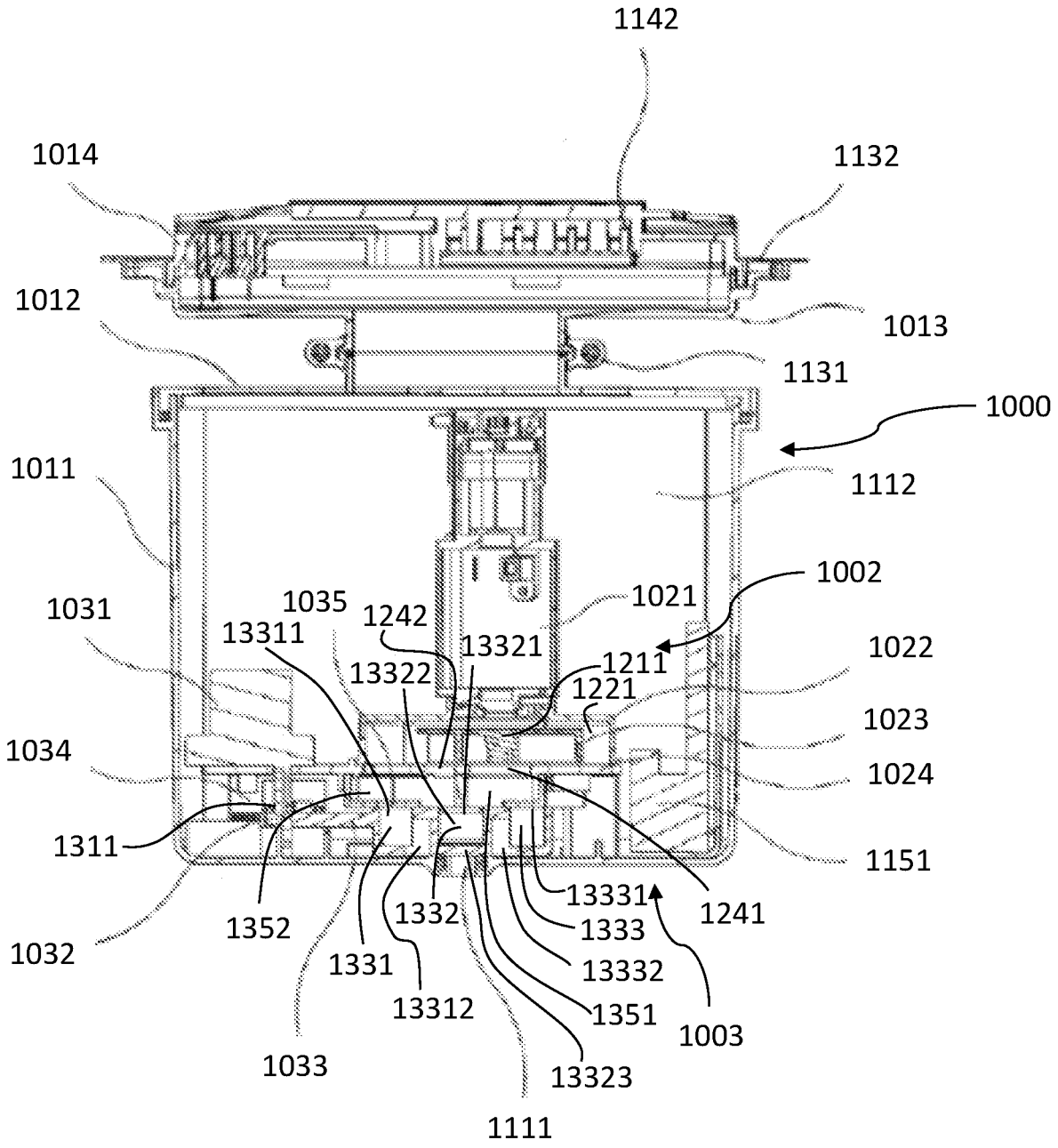
FIG. 7 is a front cross-sectional view of the air assembly of FIG. 1, said air assembly in a closed state.

After inflation to a desired pressure is achieved, the user may use the control key 1142 to place the air assembly 1000 in the closed state, as portrayed by FIG. 7. The bidirectional motor 1031 of the inflation and deflation switching mechanism 1003 begins rotation in a second, opposite direction, driving the gear disc 1032 to move the directional control valve 1033 via the rack 1334 in the opposite direction until the baffle 13323 of the second vent 1332 on the directional control valve 1033 seals the inflation and deflation port 1111 of the main body 1011. Meanwhile, the sensed element 1335 of the rack 1334 no longer touches the optical coupler detection plate 1034, and so the unidirectional motor 1021 stops operation.

Figure 5:
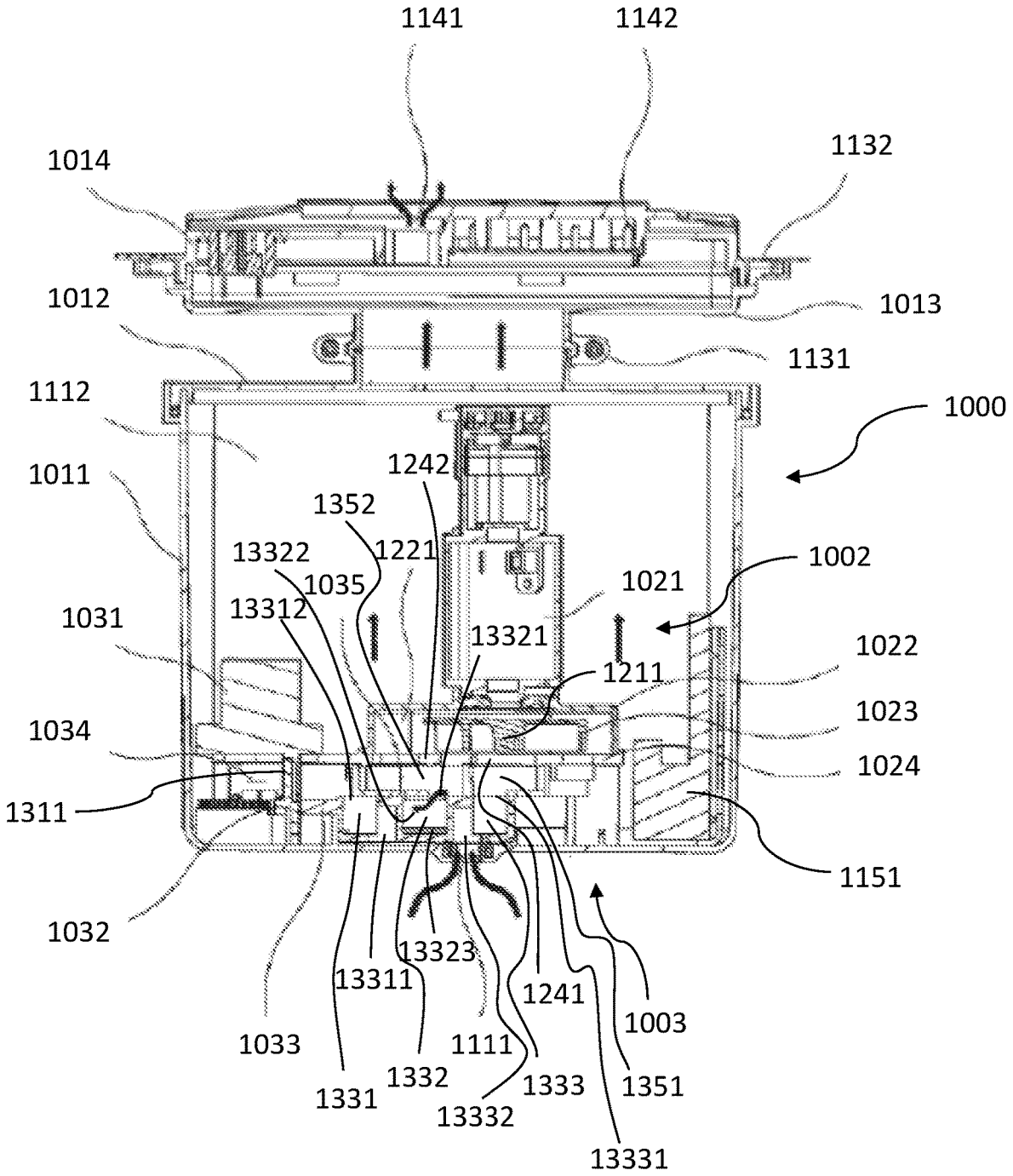
FIG. 5 is a front cross-sectional view of the air assembly of FIG. 1, said air assembly in a deflation state.
Figure 6:
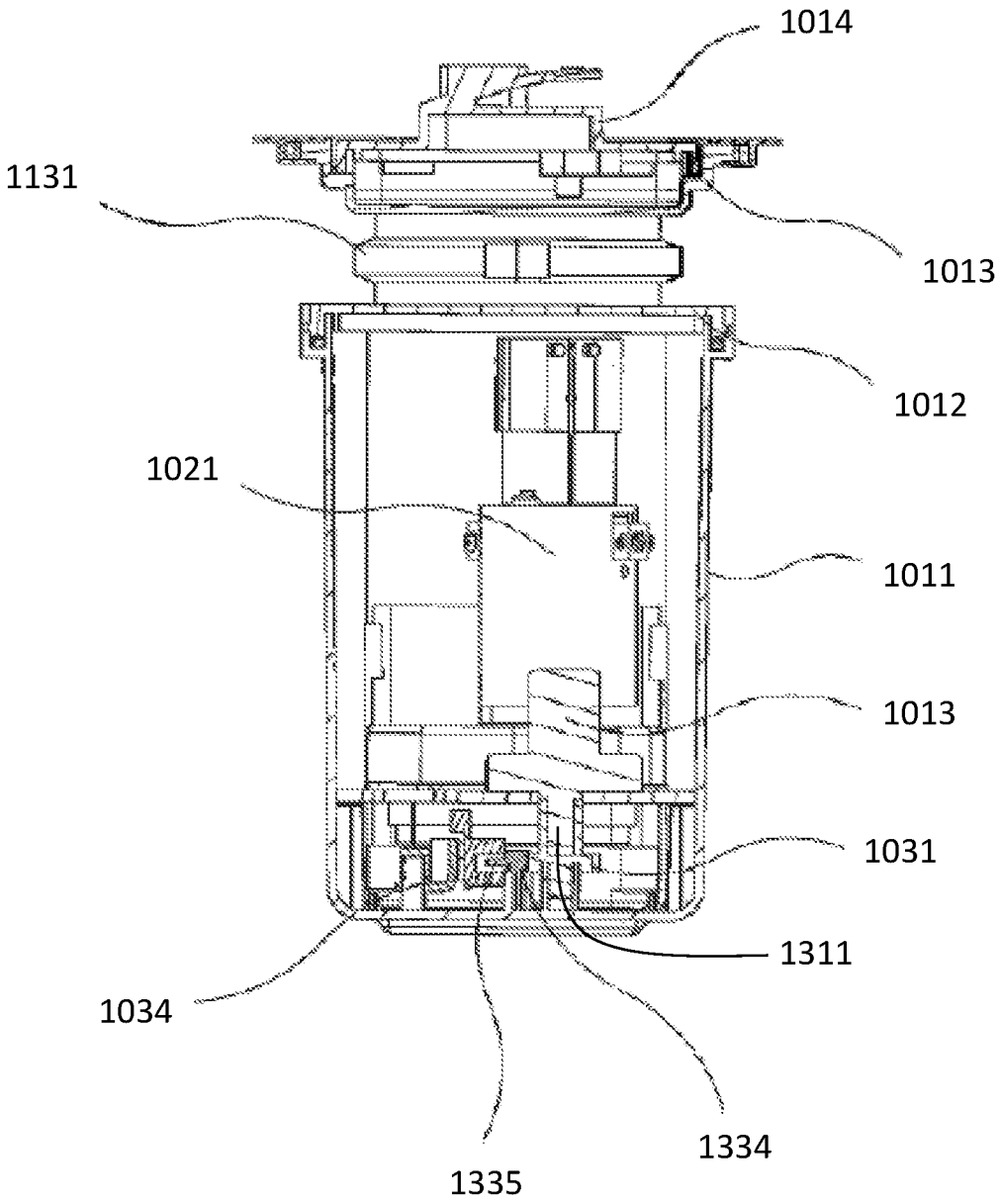
FIG. 6 is a side cross-sectional view of the air assembly of FIG. 5.

Now referring to FIGS. 5 and 6, when the user uses the control key 1142 to place the air assembly 1000 in the deflation state, the bidirectional motor 1031 of the inflation and deflation switching mechanism 1003 drives the gear disc 1032 to rotate in the second direction, and the gear disc 1032 drives the directional control valve 1033 to move via the rack 1334 until the third vent 1333 on the directional control valve 1033 is in communication with the inflation and deflation port 1111 of the main body 1011, the first aperture 1351 of the cover plate 1035, and the air inlet 1241 of the pump cover. At this point, the second vent 1332 of the directional control valve 1033 is in communication with the main body chamber 1112, the second aperture 1352 of the cover plate 1035, and the air outlet 1242 of the pump cover 1024. Furthermore, the sensed element 1335 on the rack 1334 touches the left-side deflation sensors 1034*b* of the optical coupler detection plate 1034 (FIG. 1), at which point the bidirectional motor 1031 stops operation.

When the sensed element 1335 on the rack 1334 is detected by the optical coupler detection plate 1034, the circuit board 1015 starts the unidirectional motor 1021 of the pump assembly 1002. The unidirectional motor 1021 drives the impeller 1023 to rotate via the rotational shaft 1211 so that the air in the inflatable product P is drawn into the pump body chamber 1221 through the inflation and deflation port 1111 of the main body 1011, the third vent 1333 of the directional control valve 1033, the first aperture 1351 of the cover plate 1035, and the air inlet 1241 of the pump cover 1024. The air then passes through the air outlet 1242 of the pump cover 1024, the second aperture 1352 of the cover plate 1035, and the second vent 1332 of the directional control valve 1033 to enter the main body chamber 1112. The air is then free to exit the air assembly 1000 through the vent 1141 of the control panel 1014, thus deflating the inflatable product P (FIG. 2).

Again referring to FIG. 7, after deflation to the desired pressure is achieved, the user may use the control key 1142 to place the air assembly 1000 in the closed state. The bidirectional motor 1031 of the inflation and deflation switching mechanism 1003 begins rotation in the first, opposite direction, driving the gear disc 1032 to move the directional control valve 1033 via the rack 1334 in the opposite direction until the baffle 13323 of the second vent 1332 on the directional control valve 1033 seals the inflation and deflation port 1111 of the main body 1011. Meanwhile, the sensed element 1335 of the rack 1334 no longer touches the optical coupler detection plate 1034, and so the unidirectional motor 1021 stops operation.

Figure 8:
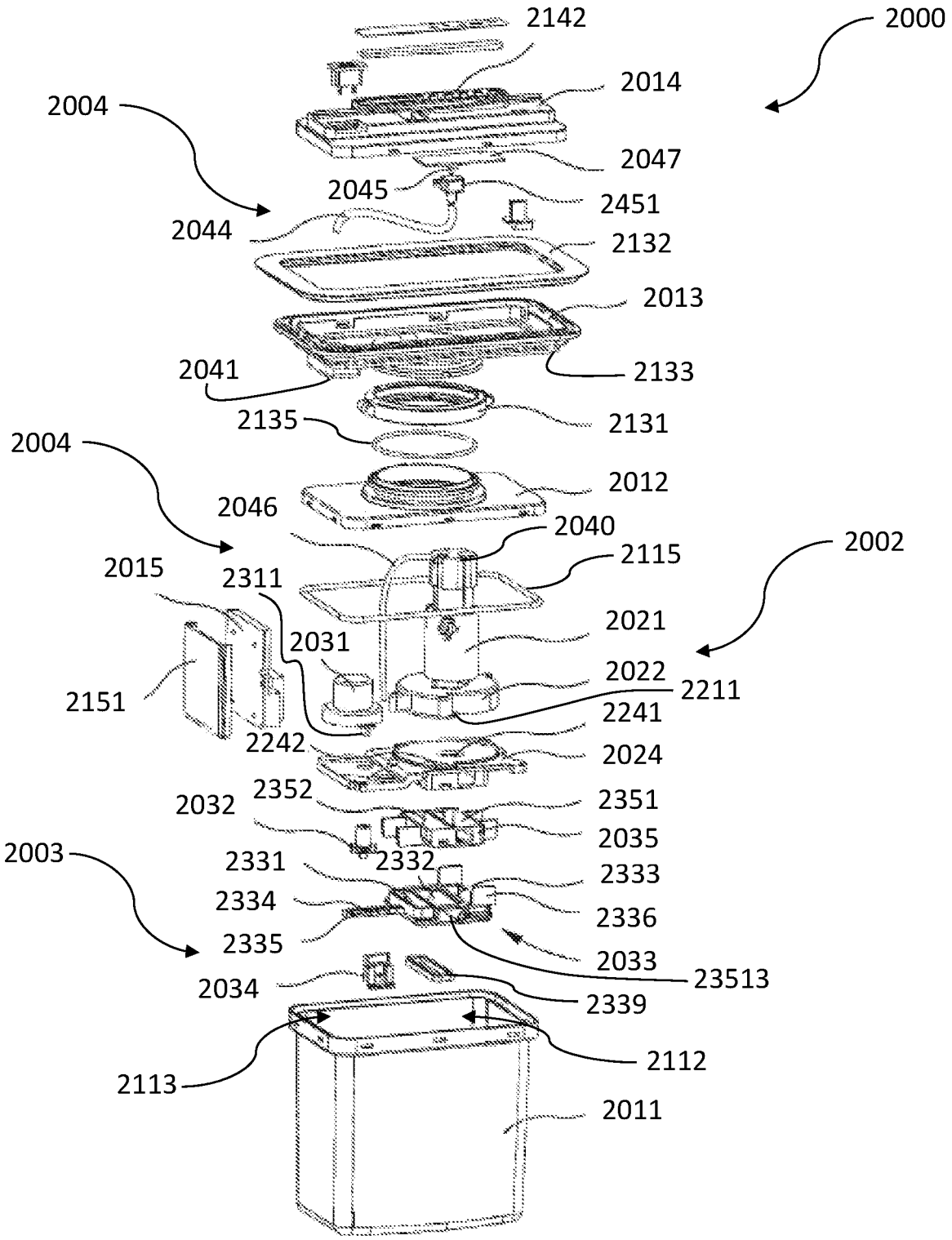
FIG. 8 is an exploded view of another exemplary embodiment of an air assembly of the present disclosure, the air assembly including a main body, a pump assembly, an inflation and deflation switching mechanism, and a pressure maintenance assembly.
Figure 9:
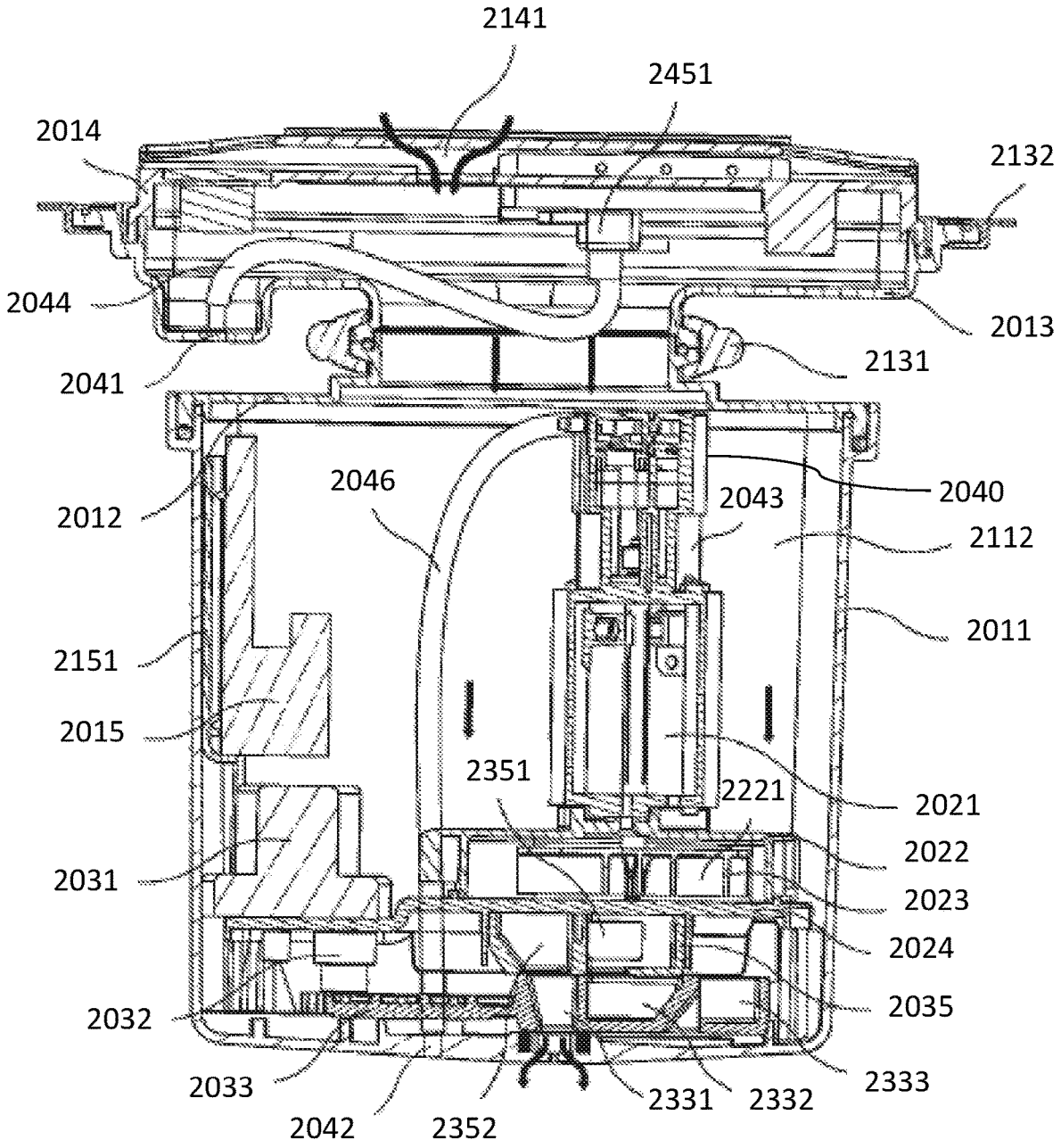
FIG. 9 is a front cross-sectional view of the air assembly of FIG. 8, said air assembly in an inflation state.

Now referring to FIGS. 8-9, another embodiment of air assembly 2000 is disclosed. The air assembly 2000 has substantially the same structure and operation as the air assembly 1000, except as described below. For example, the inflation state, the deflation state, and the closed state, including the operation of each, of the air assembly 2000 is substantially the same as the inflation state, the deflation state, and the closed state. Like elements of the air assembly 2000 are identified by adding "1000" to the corresponding reference number of the air assembly 1000.

Referring to FIG. 8, to increase the amount of air intake of the pump body chamber 2221 during inflation of the inflatable product P (FIG. 2), the first aperture 2351 of the cover plate 2035 may include a side port 23513 located in a sidewall of the cover plate 2035. When the air assembly 2000 is in an inflation state as shown in FIG. 9, the air in the main body chamber 2112 can then enter the pump body chamber 2221 through the side port 23513 of the first aperture 2351 in addition to the second vent 2332 of the directional control valve 2033 and the first aperture 2351 of the cover plate 2035.

Figure 10:
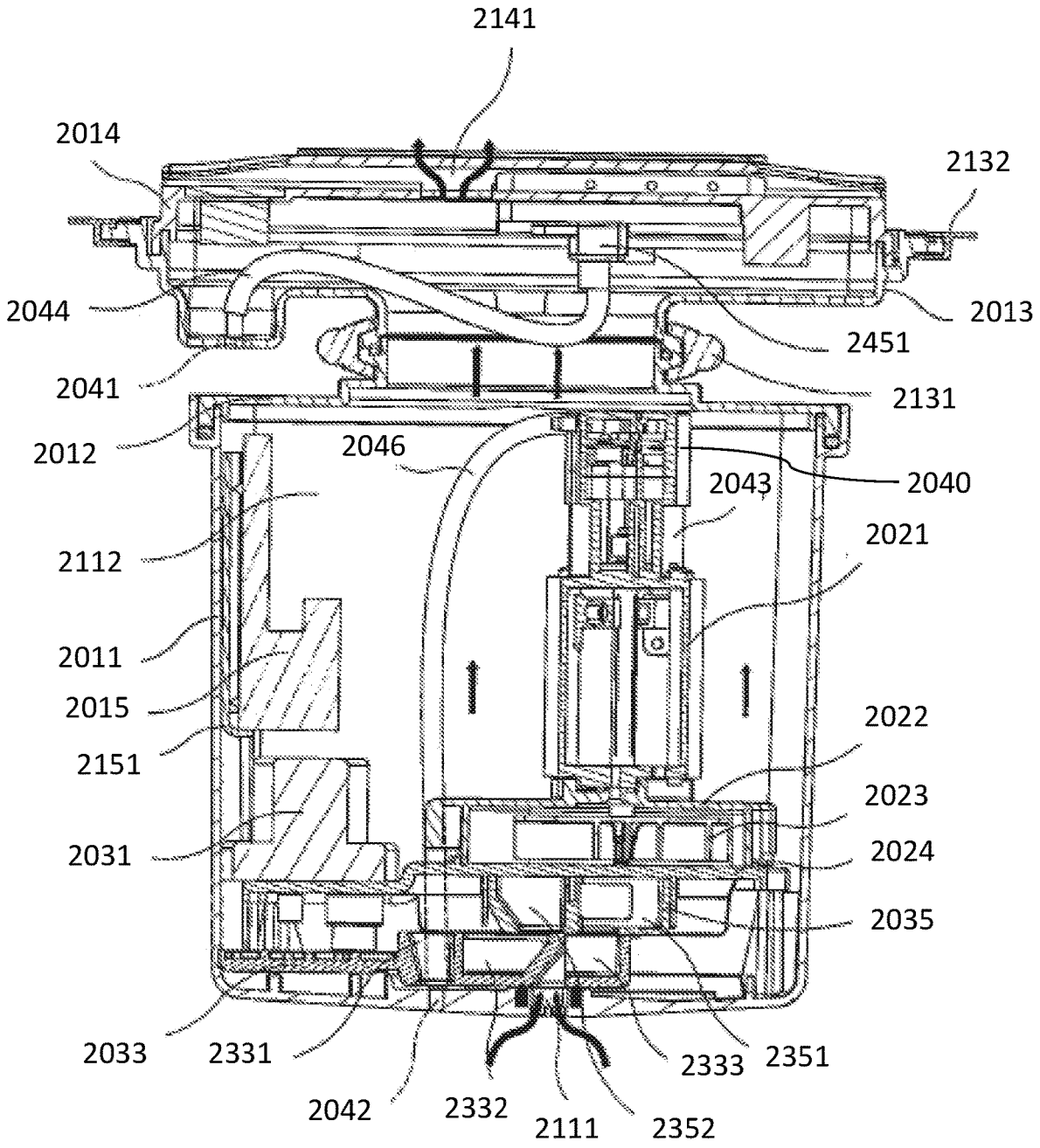
FIG. 10 is a front cross-sectional view of the air assembly of FIG. 8, said air assembly in a deflation state.

The directional control valve 2033 may further include a guide arm 2336 disposed upon the directional control valve 2033 and configured to guide the directional control valve 2033 during movement. Furthermore, when the air assembly 2000 is in a deflation state as shown in FIG. 10, the guide arm 2336 may be positioned to cover the side port 23513 of the first aperture 2351 of the cover plate 2035 to ensure that the air is pulled from the inflatable product P during deflation, rather than the main body chamber 2112.

It is known that air leakage may occur in inflatable products. While such leakage may not render the inflatable product P (FIG. 2) unusable, the leakage may affect the comfort of the inflatable product P (FIG. 2). As such, the air assembly 2000 may include an automatic pressure maintenance assembly 2004 to address such situations.

Referring generally to FIGS. 8-11, the pressure maintenance assembly 2004 includes a pressure detection hole 2041 located on the lower end 2133 of the panel seat 2013 so that, when assembled, the pressure detection hole 2041 is in communication with the inflatable product P (FIG. 2). A pressure detection tube 2044 is coupled to the pressure detection hole 2041 at a first end, while a second end of the pressure detection tube 2044 is coupled to a pressure sensor 2045 in operative communication with a second circuit board 2047 located under the control panel 2014. In some embodiments, the pressure sensor 2045 may include a cover 2451 to protect the pressure sensor 2045.

The second circuit board 2047 is operatively coupled to a supplemental pump 2040, which is coupled to the unidirectional motor 2021 opposite the impeller 2023 and in communication with the pump body chamber 2221 via an internal filling passage 2043 and with the inflatable product P via an air filling tube 2046. The air filling tube 2046 is coupled to the filling passage 2043 via a first end of the air filling tube 2046, and the air filling tube 2046 further includes a second end coupled to an air inlet 2042 located on the lower end of the main body 2011 opposite of the opening 2113 in the upper end of the main body chamber 2112 and in communication with the inflatable product P (FIG. 2). The supplemental pump 2040 may be controlled by operating the motor 2021 at a different speed and/or direction than when operating the impeller 2023. The supplemental pump 2040 may be a piston pump or another suitable pump and is further described by U.S. Publication No. 2018/0335042, the disclosure of which is herein expressly incorporated by reference.

Figure 11:
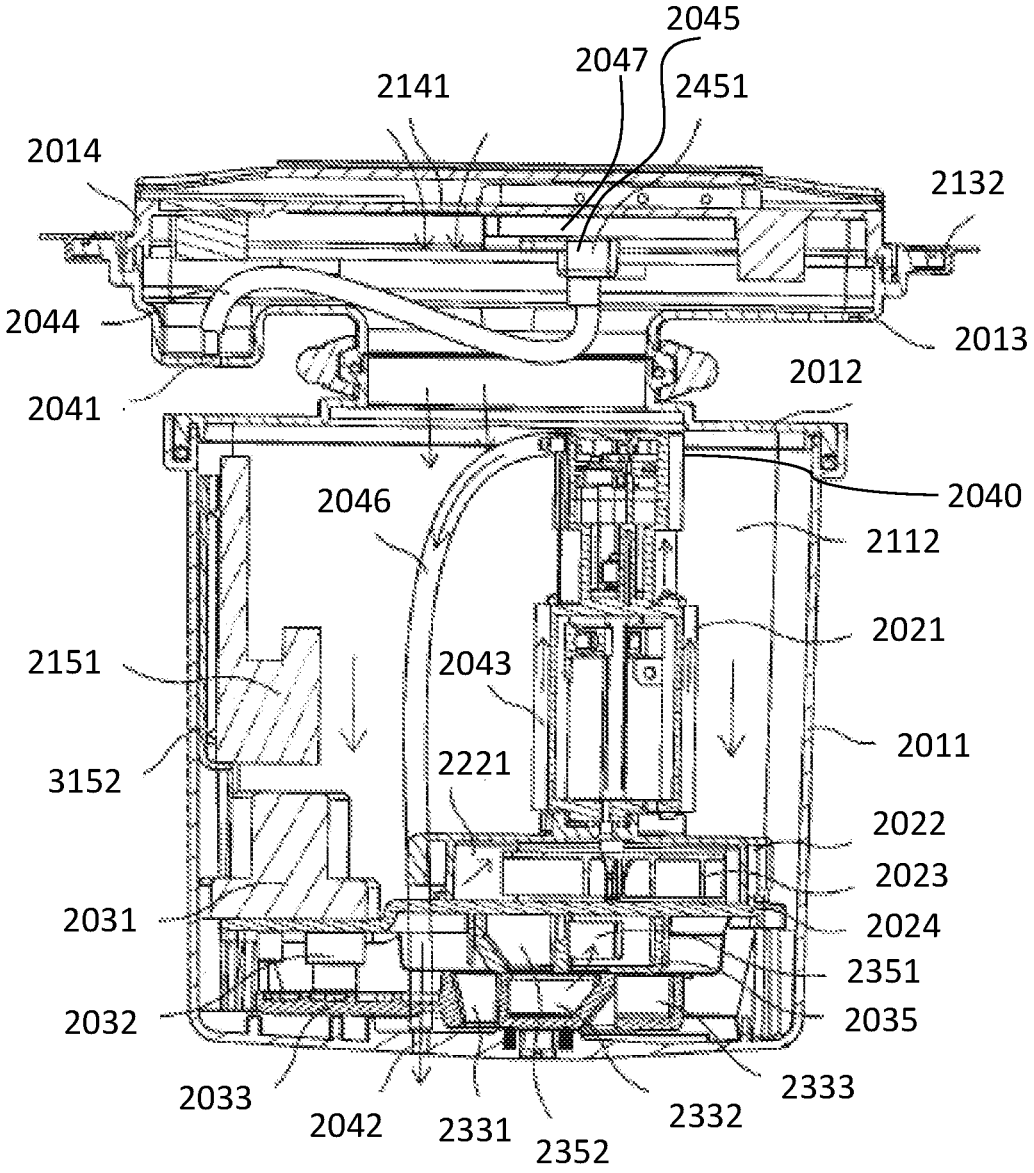
FIG. 11 is a front cross-sectional view of the air assembly of FIG. 8, said air assembly in a maintenance state.

As shown specifically in FIG. 11, when in a closed state, the pressure sensor 2045 may continuously or periodically monitor the air pressure of the inflatable product P (FIG. 2) via pressure detection tube 2044 and the pressure detection hole 2041. The air pressure value detected by the pressure sensor 2045 is communicated to the second circuit board 2047, which compares the detected air pressure value with a predetermined threshold air pressure value. In some embodiments, the predetermined threshold air pressure value is pre-programmed on the second circuit board 2047. In other embodiments, the predetermined threshold air pressure value may be programmed by the user through manual adjustment.

If the detected air pressure value is lower than the predetermined threshold air pressure value, the air assembly 2000 enters a maintenance state. For example, the second circuit board 2047 starts the unidirectional motor 2021, driving the impeller 2023 to rotate. The rotation of the impeller 2023 draws ambient air through the vent 2141 of the control panel 2014. The air is then drawn into the pump body chamber 2221 through the second vent 2332 of the directional control valve 2033, the first aperture 2351 of the cover plate 2035, and the pump cover inlet 2241. During the regular inflation state as described above with reference to FIG. 9, the air in the pump body chamber 2112 enters the inflatable product P through the open port 2111. However, because port 2111 is closed and because the motor 2021 operates the supplemental pump 2040 while the air assembly 2000 is in the maintenance state, air enters the inflatable product P (FIG. 2) by flowing from the pump body chamber 2112 through the supplemental pump 2043 of the motor 2021, through the air filling tube 2046, and out of the air filling hole 2042 into the inflatable product P (FIG. 2).

In an illustrative embodiment, the motor output power during the maintenance state of the air assembly 2000 is much lower than that of the motor output power when the air assembly 2000 is in an inflation state or a deflation state, so that the noise generated during the maintenance state of the air assembly 2000 will be low and not affect a resting user. In other embodiments, the motor output power during the maintenance state of the air assembly 2000 may the same or greater than the motor output power when the air assembly 2000 is in an inflation state or a deflation state.

Various features of the above-described air assemblies 1000, 2000 may be selectively combined. For example, air assembly 1000 may include extra cover plate apertures to increase the amount of air intake of the pump body chamber during inflation, such as air assembly 2000 having a side port 23513 to the first aperture 2351 of the cover plate 2035. In another example, air assembly 1000 may include a pressure maintenance assembly to ensure continuous air pressure in the inflatable product, such as air assembly 2000 having a pressure maintenance assembly 2004 as described above.

Although the above-described directional control valves 1033, 2033 move by operating the corresponding electronic actuators 1142, 2142, it is also within the scope of the present disclosure that the directional control valves 1033, 2033 may be moved by operating manual actuators.

While this invention has been described as having exemplary designs, the present invention can be further modified within the spirit and scope of this disclosure. This application is therefore intended to cover any variations, uses, or adaptations of the invention using its general principles. Further, the application is intended to cover such departure from the present disclosure as come within known or customary practice in the art to which this invention pertains and which fall within the limits of the appended claims.

What is claimed is:

1. An air assembly for use with an inflatable product, the air assembly comprising:

a main body forming a main body chamber, the main body comprising at least one vent in communication with the inflatable product;

a control panel coupled to the main body, the control panel comprising a vent in communication with the surrounding environment and the main body chamber;

an electronic actuator disposed on the control panel and operably coupled to a first circuit board;

a pump body disposed in the main body chamber;

a pump cover disposed in the main body chamber, the pump cover cooperating with the pump body to form an impeller chamber and including an air inlet and an air outlet in communication with the impeller chamber;

an impeller disposed within the impeller chamber;

a first motor disposed within the main body chamber and operably coupled to the impeller, the impeller configured to direct air from the air inlet to the air outlet of the pump cover;

a second motor disposed within the main body chamber;

a directional control valve coupled to the second motor and disposed within the main body chamber, the directional control valve moveable between:

a first position corresponding to an inflation state in which the directional control valve opens an airway between the air outlet of the pump cover and the at least one vent in the main body to inflate the inflatable product;

a second position corresponding to a deflation state in which the directional control valve opens an airway between the air inlet of the pump cover and the at least one vent in the main body to deflate the inflatable product; and a third position corresponding to a closed state in which the directional control valve blocks airflow between the pump cover and the at least one vent in the main body to close the inflatable product; and a cover plate disposed between the directional control valve and the pump cover, the cover plate having:

a first aperture in communication with the air inlet of the pump cover and in selective communication with the at least one vent in the main body; and a second aperture in communication with the air outlet of the pump cover and in selective communication with the at least one vent in the main body.

2. The air assembly of claim 1, wherein the first aperture of the cover plate has a side port in a sidewall of the cover plate.

3. The air assembly of claim 2, wherein the directional control valve includes a guide arm configured to selectively cover the side port of the first aperture of the cover plate.

4. An air assembly for use with an inflatable product, the air assembly comprising:

a main body forming a main body chamber, the main body comprising at least one vent in communication with the inflatable product;

a control panel coupled to the main body, the control panel comprising a vent in communication with the surrounding environment and the main body chamber;

an electronic actuator disposed on the control panel and operably coupled to a first circuit board;

a pump body disposed in the main body chamber;

a pump cover disposed in the main body chamber, the pump cover cooperating with the pump body to form an impeller chamber and including an air inlet and an air outlet in communication with the impeller chamber;

an impeller disposed within the impeller chamber;

a first motor disposed within the main body chamber and operably coupled to the impeller, the impeller configured to direct air from the air inlet to the air outlet of the pump cover;

a second motor disposed within the main body chamber; and a directional control valve coupled to the second motor and disposed within the main body chamber, the directional control valve including a first vent, a second vent and a baffle between the first and second vents, the directional control valve moveable between:

a first position corresponding to an inflation state in which the directional control valve opens an airway between the air outlet of the pump cover and the at least one vent in the main body to inflate the inflatable product, wherein in the inflation state, the first vent communicates with the at least one vent in the main body;

a second position corresponding to a deflation state in which the directional control valve opens an airway between the air inlet of the pump cover and the at least one vent in the main body to deflate the inflatable product, wherein in the deflation state, the second vent communicates with the at least one vent in the main body; and a third position corresponding to a closed state in which the directional control valve blocks airflow between the pump cover and the at least one vent in the main body to close the inflatable product, wherein in the closed state, the baffle covers the at least one vent in the main body.

5. The air assembly of claim 4, wherein the directional control valve is disposed between the at least one vent in the main body and the pump cover.

6. The air assembly of claim 4, wherein the second motor is activated in the inflation and deflation states and deactivated in the closed state based on the position of the directional control valve.

7. The air assembly of claim 4, wherein the third position is between the first and second positions.

8. The air assembly of claim 4, the air assembly further comprising a pressure maintenance assembly, the pressure maintenance assembly comprising:

a pressure detection hole disposed in a panel seat that supports the control panel, the pressure detection hole communicating with the inflatable product;

a pressure detection tube with a first end and a second end, the first end coupled to the pressure detection hole;

a second circuit board operatively coupled to the first motor, the second circuit board supporting a pressure sensor coupled to the second end of the pressure detection tube;

a supplemental pump operably coupled to the first motor opposite the impeller; and an air filling tube with a first end coupled to the supplemental pump and a second end coupled to a second vent located on the main body in communication with the inflatable product.

9. The air assembly of claim 8, wherein the second motor is supported by the pump cover.

10. The air assembly of claim 4, wherein the control panel is detachably coupled to the main body via a snap ring.

11. The air assembly of claim 10, further comprising a soft ring disposed between the snap ring and the control panel, wherein the soft ring is coupled to a wall of the inflatable product.

12. The air assembly of claim 11, wherein the soft ring is welded or adhered to the wall of the inflatable product.

13. An air assembly for use with an inflatable product, the air assembly comprising:

a main body forming a main body chamber, the main body comprising at least one vent in communication with the inflatable product;

a control panel coupled to the main body, the control panel comprising a vent in communication with the surrounding environment and the main body chamber;

an electronic actuator disposed on the control panel and communicatively coupled to a first circuit board;

a pump body disposed in the main body chamber;

a pump cover disposed in the main body chamber, the pump cover cooperating with the pump body to form an impeller chamber and including an air inlet and an air outlet in communication with the impeller chamber;

an impeller disposed within the impeller chamber;

a first motor disposed within the main body chamber and operably coupled to the impeller, the impeller configured to direct air from the air inlet to the air outlet of the pump cover;

a second motor disposed within the main body chamber and supported by the pump cover;

a directional control valve coupled to the second motor and disposed within the main body chamber, the directional control valve moveable between:

a first position corresponding to an inflation state in which the directional control valve opens an airway between the air outlet of the pump cover and the at least one vent in the main body to inflate the inflatable product;

a second position corresponding to a deflation state in which the directional control valve opens an airway between the air inlet of the pump cover and the at least one vent in the main body to deflate the inflatable product; and a third position corresponding to a closed state in which the directional control valve blocks airflow between the pump cover and the at least one vent in the main body to close the inflatable product;

a cover plate disposed between the directional control valve and the pump cover, the cover plate having a side port located on a sidewall of the cover plate; and a guide arm coupled to the directional control valve that exposes the side port in the inflation state and covers the side port in the deflation state; and a pressure maintenance assembly, the pressure maintenance assembly comprising:

a pressure detection hole disposed in a panel seat that supports the control panel, the pressure detection hole communicating with the inflatable product;

a pressure detection tube with a first end and a second end, the first end coupled to the pressure detection hole;

a second circuit board operatively coupled to the first motor, the second circuit board supporting a pressure sensor coupled to the second end of the pressure detection tube;

a supplemental pump operably coupled to the first motor opposite the impeller; and an air filling tube with a first end coupled to the supplemental pump and a second end coupled to a second vent located on the main body in communication with the inflatable product.

14. The air assembly of claim 13, the cover plate having:

a first aperture in communication with the air inlet of the pump cover and in selective communication with the at least one vent in the main body, the first aperture including the side port; and a second aperture in communication with the air outlet of the pump cover and in selective communication with the at least one vent in the main body.

15. The air assembly of claim 13, the air assembly further comprising a snap ring coupled to the control panel and detachably coupled to the main body.

16. The air assembly of claim 15, further comprising a soft ring disposed between the snap ring and the control panel, wherein the soft ring is coupled to a wall of the inflatable product.

* * * * *